US009939189B2

(12) United States Patent
Koo et al.

(10) Patent No.: US 9,939,189 B2
(45) Date of Patent: Apr. 10, 2018

(54) REFRIGERATOR

(71) Applicant: SAMSUNG ELECTRONICS CO., LTD., Suwon-si, Gyeonggi-do (KR)

(72) Inventors: Keon Pyo Koo, Gwangju (KR); Byung Su Kim, Gwnagju (KR); Ji Hoon Lim, Daejeon (KR); Hyun Young Jo, Changwon-si (KR); Hun Kwan Kang, Gwangju (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 471 days.

(21) Appl. No.: 14/514,553

(22) Filed: Oct. 15, 2014

(65) Prior Publication Data

US 2015/0153097 A1 Jun. 4, 2015

(30) Foreign Application Priority Data

Nov. 29, 2013 (KR) ..... 10-2013-0146750

(51) Int. Cl.
*F25D 17/06* (2006.01)
*F25D 23/00* (2006.01)
*F25B 31/00* (2006.01)

(52) U.S. Cl.
CPC ..... *F25D 23/003* (2013.01); *F25B 31/006* (2013.01); *F25D 23/006* (2013.01);
(Continued)

(58) Field of Classification Search
CPC ..... F25D 23/003; F25D 23/006; F25D 2323/00261; F25D 2323/00267;
(Continued)

(56) References Cited

U.S. PATENT DOCUMENTS 1,839,689 A * 1/1932 Lipman ..... F25D 23/003 62/450
2008/0229630 A1* 9/2008 Mullenbach ..... D06F 81/06 38/104

(Continued)

FOREIGN PATENT DOCUMENTS

DE 25 21 185 11/1975
DE 202008001432 U1 * 5/2009 ..... F25D 23/003

(Continued)

OTHER PUBLICATIONS

Translation of KR 1020120135768.*

(Continued)

*Primary Examiner* — Elizabeth Martin
(74) *Attorney, Agent, or Firm* — Staas & Halsey LLP

(57) ABSTRACT

A refrigerator having a flow channel device provided at opposite sides of a machinery compartment to introduce and discharge external air into the machinery compartment. The refrigerator includes a main body including an inner liner having a storage compartment defined therein, an outer liner coupled to an outside of the inner liner to form an external appearance thereof, and an insulation member filled between the inner liner and the outer liner, a machinery compartment, provided at a lower part of the main body, in which a compressor is disposed, and a flow channel device provided at opposite sides of the machinery compartment such that external air is introduced into the machinery compartment, flows along the machinery compartment, and is discharged from the machinery compartment, wherein the flow channel device extends through the insulation member filled between the outer liner and an inner wall of the machinery compartment.

23 Claims, 13 Drawing Sheets

(52) U.S. Cl.
CPC *F25B 2400/06* (2013.01); *F25D 2323/00261* (2013.01); *F25D 2323/00267* (2013.01); *F25D 2323/00271* (2013.01); *F25D 2323/00277* (2013.01)

(58) Field of Classification Search
CPC . F25D 2323/00271; F25D 2323/00277; F25B 31/006; F25B 2400/06
USPC ..... 62/411
See application file for complete search history.

(56) References Cited

U.S. PATENT DOCUMENTS

| | | | | |
|---|---|---|---|---|
| 2009/0013713 | A1 | 1/2009 | Cho et al. | |
| 2009/0169387 | A1* | 7/2009 | Yoo | F04D 29/668 416/190 |
| 2010/0192617 | A1* | 8/2010 | Chae | F25D 17/065 62/419 |
| 2011/0030402 | A1 | 2/2011 | Shinya et al. | |

FOREIGN PATENT DOCUMENTS

| | | | | |
|---|---|---|---|---|
| DE | 20 2008 001 432 | | 6/2009 | |
| JP | 58-129484 | | 9/1983 | |
| JP | 3-67971 | * | 7/1991 | F25D 19/00 |
| JP | 6-147727 | | 5/1994 | |
| JP | 6-147728 | | 5/1994 | |
| JP | 8-257327 | | 10/1996 | |
| JP | 8-285439 | * | 11/1996 | F25D 19/00 |
| JP | H08285439 A | | 11/1996 | |
| JP | 2002-267353 | | 9/2002 | |
| JP | 2007-303791 | | 11/2007 | |
| JP | 2009-109078 | | 5/2009 | |
| JP | 2011-58691 | | 3/2011 | |
| JP | 2012-229915 | | 11/2012 | |
| KR | 1999-0018697 | | 6/1999 | |
| KR | 10-2009-0100772 | | 9/2009 | |
| KR | 10-2012-0135768 | * | 12/2012 | F25D 19/00 |
| KR | 10-2012-0135768 A | | 12/2012 | |

OTHER PUBLICATIONS

International Search Report dated Feb. 25, 2015 in corresponding International Patent Application No. PCT/KR2014/011437.
Australian Office Action dated Oct. 7, 2016 in corresponding Australian Patent Application No. 2014354427.
European Search Report dated May 8, 2015 in corresponding European Patent Application No. 14187167.3.
Canadian Office Action dated Jan. 26, 2017 in related Canadian Patent Application No. 2,923,042 (3 pages).
2nd Examination Report dated Mar. 9, 2017 in related Australian Patent Application No. 2014354427 (4 pages).
Notice of Allowance dated Jul. 4, 2017 in related Canadian Patent Application No. 2,923,042 (1 page).
Examination Report No. 3, dated Jun. 16, 2017, in related Australian Patent Application No. 2014354427 (5 pages).
Australian Notice of Acceptance for Patent Application dated Oct. 11, 2017 in corresponding Australian Patent Application No. 2014354427.
Australian Examination Report dated Oct. 3, 2017 in corresponding Australian Patent Application No. 2014354427.

* cited by examiner

REFRIGERATOR

CROSS-REFERENCE TO RELATED APPLICATIONS

This application claims the benefit of Korean Patent Application No. 10-2013-0146750, filed on Nov. 29, 2013 in the Korean Intellectual Property Office, the disclosure of which is incorporated herein by reference.

BACKGROUND

1. Field

Embodiments of the present disclosure relate to a refrigerator having a flow channel device provided at the side of a machinery compartment.

2. Description of the Related Art

Generally, a refrigerator is an apparatus having a main body including an inner liner and an outer liner, a storage compartment defined by the inner liner, and a cool air supply device to supply cool air to the storage compartment to freshly store food.

Temperature of the storage compartment is maintained within a predetermined temperature range required to freshly store food.

The storage compartment of the refrigerator is configured such that the front of the storage compartment is open and the open front of the storage compartment is normally closed by a door to uniformly maintain temperature of the storage compartment.

A machinery compartment, in which a compressor, a condenser, etc. are disposed, is provided at the lower part of the rear of the main body. In the machinery compartment is provided a heat dissipation fan to dissipate heat from the compressor and the condenser disposed in the machinery compartment.

However, the machinery compartment is hermetically sealed. As a result, the heat from the compressor and the condenser may not be efficiently dissipated using the heat dissipation fan alone.

SUMMARY

It is an aspect of the present disclosure to provide a refrigerator having a flow channel device provided at opposite sides of a machinery compartment such that external air is introduced into the machinery compartment, flows along the machinery compartment, and is discharged from the machinery compartment.

Additional aspects of the disclosure will be set forth in part in the description which follows and, in part, will be apparent from the description, or may be learned by practice of the disclosure.

In accordance with an aspect of the present disclosure, a refrigerator includes a main body including an inner liner having a storage compartment defined therein, an outer liner coupled to an outside of the inner liner to form an external appearance thereof, and an insulation member filled between the inner liner and the outer liner, a machinery compartment, provided at a lower part of the main body, in which a compressor is disposed, and a flow channel device provided at opposite sides of the machinery compartment such that external air is introduced into the machinery compartment, flows along the machinery compartment, and is discharged from the machinery compartment, wherein the flow channel device extends through the insulation member filled between the outer liner and an inner wall of the machinery compartment.

The flow channel device may include a machinery compartment inner wall assembly forming opposite inner side walls of the machinery compartment, the machinery compartment inner wall assembly having a first opening, a case unit disposed between the outer liner and the machinery compartment inner wall assembly, the case unit having an air flow channel corresponding to the first opening, and a cover unit to cover a second opening provided at the outer liner, the second opening corresponding to the first opening.

The machinery compartment may have a machinery compartment heat dissipation fan to dissipate heat from the machinery compartment provided therein and the first opening may have a height corresponding to that of the machinery compartment heat dissipation fan.

The machinery compartment inner wall assembly may include a plane part forming a side wall of the machinery compartment and an extension part extending from the plane part toward the outer liner to form a space in which the case unit is disposed between the plane part and the outer liner.

The plane part may be provided with the first opening and a case unit coupling part, to which the case unit is coupled.

The case unit coupling part may be provided with a plurality of insertion holes and the case unit may be coupled to the case unit coupling part by fastening members inserted into the insertion holes.

The case unit may be coupled to the case unit coupling part by double-sided tape.

The case unit may be coupled to the machinery compartment inner wall assembly such that the air flow channel corresponds to the first opening and sponge may be disposed between the case unit and the machinery compartment inner wall assembly to seal a space between the case unit and the machinery compartment inner wall assembly.

The case unit may include the air flow channel, through which air flows, a support part to support the insulation member filled around the air flow channel, a first coupling part coupled to the case unit coupling part, a tight contact part tightly contacting the outer liner, a protruding part protruding from the tight contact part such that a portion of the protruding part protrudes outward from the second opening to seal a space between the outer liner and the case unit, and a second coupling part, to which the cover unit is coupled.

The air flow channel may be provided with a plurality of ribs arranged in a lattice shape to reinforce the support part.

The first coupling part may be provided with a plurality of coupling holes corresponding to the insertion holes such that the case unit is coupled to the machinery compartment inner wall assembly by fastening members inserted into the insertion holes.

The cover unit may be provided with a plurality of ventilation openings and a fastening part fastened to the case unit.

The fastening part may include a plurality of hook protrusions and the second coupling part may include a plurality of hook grooves corresponding to the hook protrusions such that the cover unit is coupled to the case unit by fitting.

The fastening part may include a plurality of through holes and the second coupling part may include a plurality of fastening holes corresponding to the through holes such that the cover unit is coupled to the case unit by fastening members extending through the through holes.

In accordance with another aspect of the present disclosure, a refrigerator includes a main body including an inner liner having a storage compartment defined therein, an outer liner coupled to an outside of the inner liner to form an external appearance thereof, and an insulation member filled between the inner liner and the outer liner, a machinery compartment, provided at a lower part of the main body, in which a compressor is disposed, and a flow channel device provided at opposite sides of the machinery compartment such that external air is introduced into the machinery compartment, flows along the machinery compartment, and is discharged from the machinery compartment, wherein the flow channel device includes a machinery compartment inner wall assembly forming opposite inner side walls of the machinery compartment, the machinery compartment inner wall assembly having a first opening, a case unit coupled to the machinery compartment inner wall assembly such that the case unit is disposed between the outer liner and the machinery compartment inner wall assembly, the case unit having an air flow channel corresponding to the first opening, and a cover unit to cover a second opening provided at the outer liner, the second opening corresponding to the first opening, the cover unit having a plurality of ventilation openings.

The machinery compartment may have a machinery compartment heat dissipation fan to dissipate heat from the machinery compartment provided therein and the first opening may have a height corresponding to that of the machinery compartment heat dissipation fan.

The machinery compartment inner wall assembly may include a plane part forming a side wall of the machinery compartment, the plane part being provided with the first opening and a case unit coupling part, to which the case unit is coupled, and an extension part extending from the plane part toward the outer liner to form a space in which the case unit is disposed between the plane part and the outer liner.

The case unit may be coupled to the machinery compartment inner wall assembly such that the air flow channel corresponds to the first opening and sponge may be disposed between the case unit and the machinery compartment inner wall assembly to seal a space between the case unit and the machinery compartment inner wall assembly.

The case unit may include the air flow channel, through which air flows, a support part to support the insulation member filled around the air flow channel, a first coupling part coupled to the case unit coupling part, a tight contact part tightly contacting the outer liner, a protruding part protruding from the tight contact part such that a portion of the protruding part protrudes outward from the second opening to seal a space between the outer liner and the case unit, and a second coupling part, to which the cover unit is coupled.

The air flow channel may be provided with a plurality of ribs arranged in a lattice shape to reinforce the support part.

In accordance with a further aspect of the present disclosure, a refrigerator includes a main body including an inner liner having a storage compartment defined therein, an outer liner coupled to an outside of the inner liner to form an external appearance thereof, and an insulation member filled between the inner liner and the outer liner, a machinery compartment, provided at a lower part of the main body, in which a compressor is disposed, and a flow channel device provided at opposite sides of the machinery compartment such that external air is introduced into the machinery compartment, flows along the machinery compartment, and is discharged from the machinery compartment, wherein the flow channel device includes openings provided at the outer liner and an inner wall of the machinery compartment and a case unit disposed between the openings such that the case unit extends through the insulation member to interconnect the openings.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
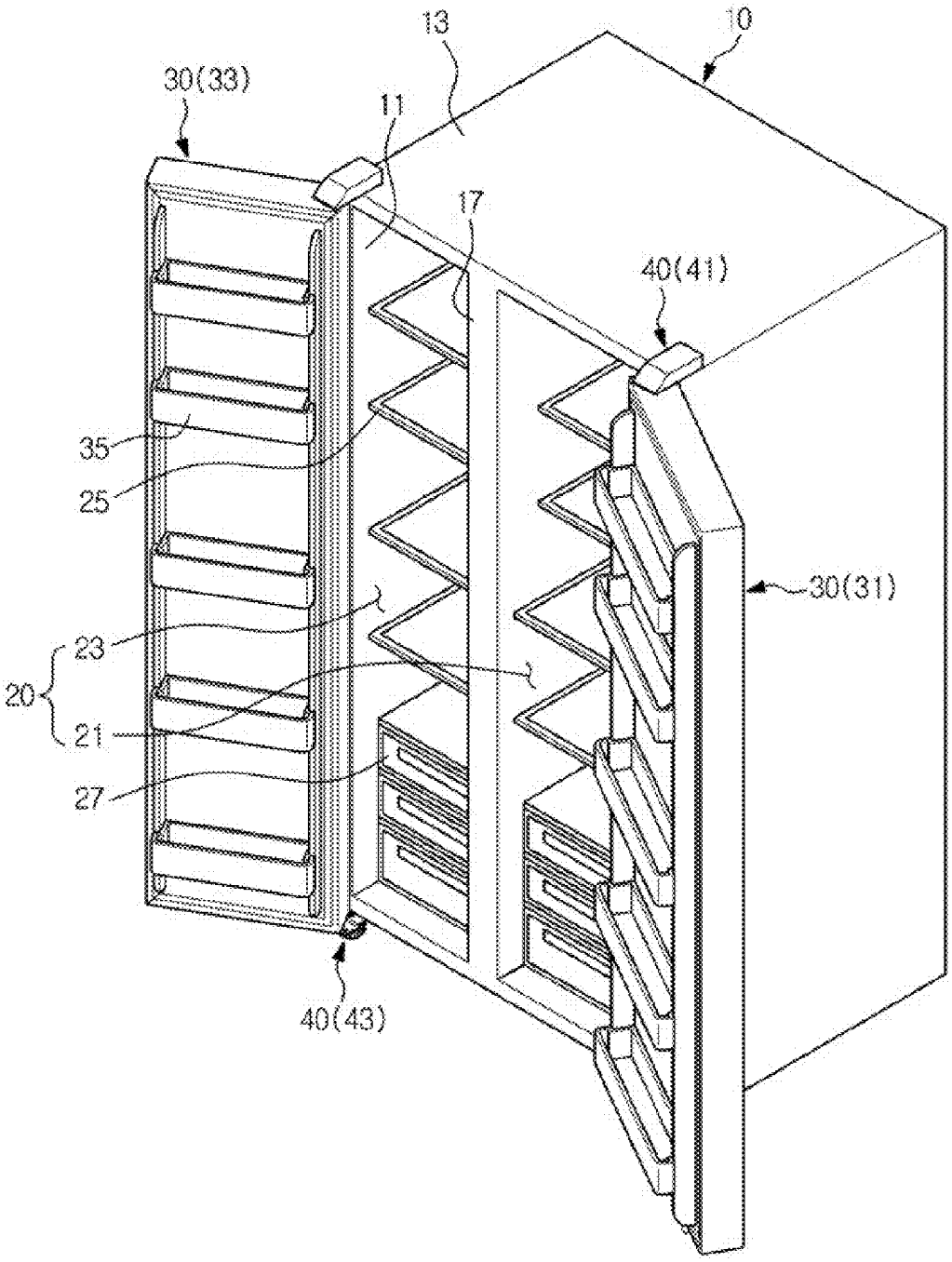
FIG. 1 is a perspective view of a refrigerator according to an embodiment of the present disclosure.
Figure 2:
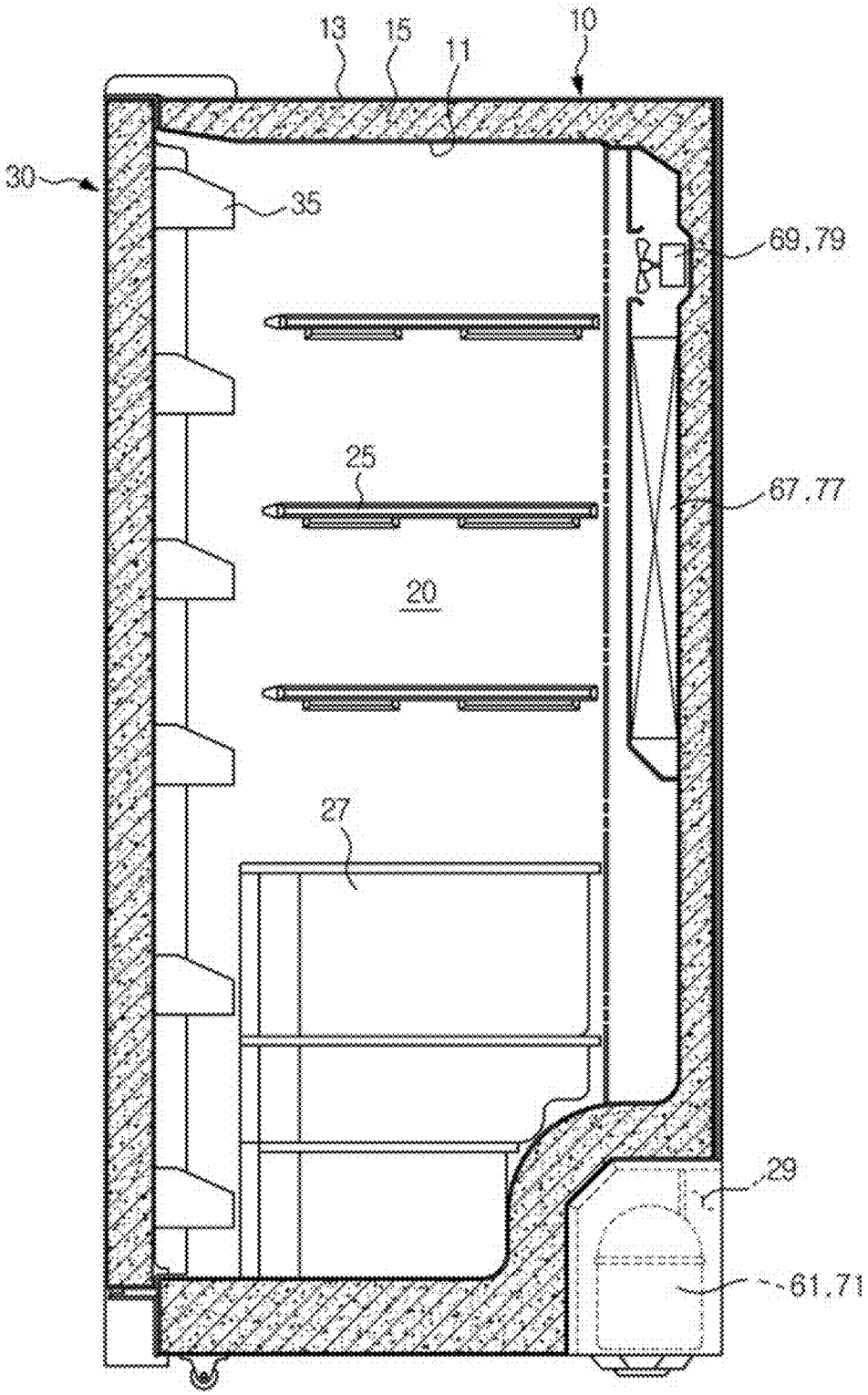
FIG. 2 is a sectional view of the refrigerator according to the embodiment of the present disclosure.
Figure 3:
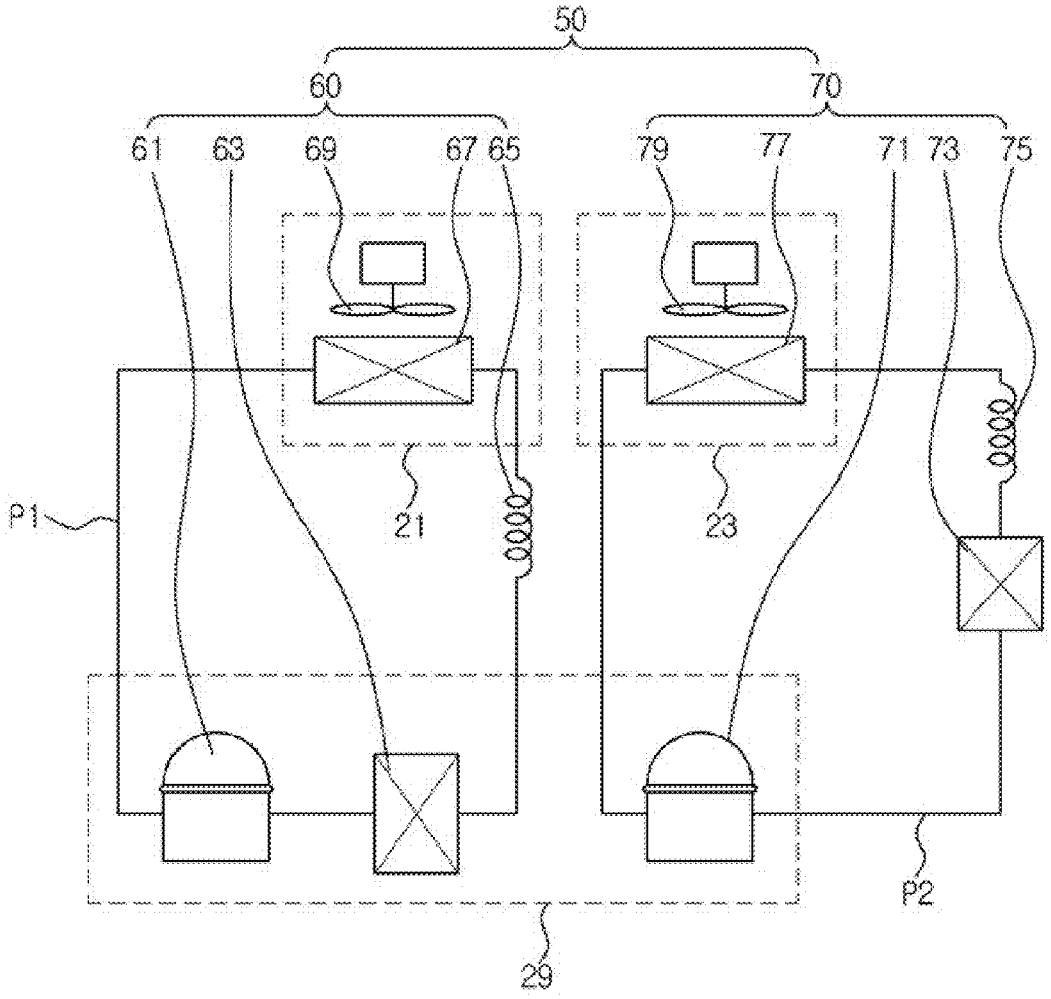
FIG. 3 is a view showing a refrigeration cycle of the refrigerator according to the embodiment of the present disclosure.

Reference will now be made in detail to the embodiments of the present disclosure, examples of which are illustrated in the accompanying drawings, wherein like reference numerals refer to like elements throughout.

As shown in FIGS. 1 to 4, a refrigerator includes a main body 10 forming the external appearance of the refrigerator, a storage compartment 20 provided in the main body 10 such that the front of the storage compartment 20 is open, a door 30 hinged to the main body 10 to open and close the open front of the storage compartment 20, a hinge module 40 including an upper hinge 41 and a lower hinge 43, by which the door 30 is hinged to the main body 10, and a cool air supply device 50 to supply cool air into the storage compartment 20.

The main body 10 includes an inner liner 11 defining the storage compartment 20 and an outer liner 13 forming the external appearance thereof. Between the inner liner 11 and the outer liner 13 is foamed an insulation member 15 to prevent leakage of cool air from the storage compartment 20.

In addition, the main body 10 includes a partition 17 to partition the storage compartment 20 into a right refrigerating compartment 21 and a left freezing compartment 23. At the lower side of the rear of the main body 10 is provided a machinery compartment 29, in which compressors 61 and 71 to compress a refrigerant and a condenser 63 to condense the compressed refrigerant are installed. A machinery compartment cover 29*a* is coupled to the rear of the machinery compartment 29.

The machinery compartment cover 29*a* may be provided at one side thereof with a suction port 29*b*, through which external air is suctioned into the machinery compartment 29, and at the other side thereof with a discharge port 29*c*, through which the air suctioned into the machinery compartment 29 is discharged outside.

The storage compartment 20 is partitioned into right and left parts by the partition 17. The refrigerating compartment 21 is provided at the right side of the main body 10 and the freezing compartment 23 is provided at the left side of the main body 10.

In the storage compartment 20 may be provided a plurality of shelves 25 and storage containers 27 to store food.

The storage compartment 20 is opened and closed by the door 30 hinged to the main body 10. The refrigerating compartment 21 and the freezing compartment 23 vertically partitioned by the partition 17 are opened and closed by a refrigerating compartment door 31 and a freezing compartment door 33, respectively.

The refrigerating compartment door 31 and the freezing compartment door 33 may be hinged to the main body 10 by the hinge module 40 including the upper hinge 41 provided at the upper part of the main body 10 and the lower hinge 43 provided at the lower part of the main body 10.

A plurality of door guards 35 to receive food, etc. are provided at the rear of the refrigerating compartment door 31 and the rear of freezing compartment door 33.

The cool air supply device 50 supplies cool air to the storage compartment 20. The cool air supply device 50 may perform a plurality of independent refrigeration cycles to independently cool the refrigerating compartment 21 and the freezing compartment 23.

To this end, the cool air supply device 50 may include a first cool air supply device 60 to supply cool air to the refrigerating compartment 21 and a second cool air supply device 70 to supply cool air to the freezing compartment 23.

The first cool air supply device 60 may circulate a first refrigerant and the second cool air supply device 70 may circulate a second refrigerant.

The terms 'first refrigerant' and 'second refrigerant' are used only to differentiate between refrigerants circulating in different refrigeration cycles through the different cool air supply devices 60 and 70.

Consequently, the first refrigerant and the second refrigerant may be of the same kind or different kinds.

Any one selected from among R-134a, R-22, R-12, and ammonia may be used as the first refrigerant and the second refrigerant.

The first cool air supply device 60 may include a first compressor 61 to compress the first refrigerant to high temperature and high pressure, a first condenser 63 to condense a gas-phase first refrigerant into a liquid-phase first refrigerant, a first expansion valve 65 to expand the first refrigerant to low temperature and low pressure, a first evaporator 67 to evaporate the liquid-phase first refrigerant into a gas-phase first refrigerant, and a first fan 69 to forcibly drive air in the refrigerating compartment 21. The first refrigerant may be guided through a first refrigerant pipe P1.

The first evaporator 67 absorbs surrounding latent heat while evaporating the first refrigerant to generate cool air. The generated cool air may be supplied to the refrigerating compartment 21 through the first fan 69.

The first compressor 61 may be a hermetically sealed reciprocating compressor and the first condenser 63 may be an air-cooled condenser having heat dissipation fins and a tube.

The first compressor 61 and the first condenser 63 may be disposed in the machinery compartment 29 provided at the lower part of the main body 10.

The second cool air supply device 70 may include a second compressor 71 to compress the second refrigerant to high temperature and high pressure, a second condenser 73 to condense a gas-phase second refrigerant into a liquid-phase second refrigerant, a second expansion valve 75 to expand the second refrigerant to low temperature and low pressure, a second evaporator 77 to evaporate the liquid-phase second refrigerant into a gas-phase second refrigerant, and a second fan 79 to forcibly drive air in the freezing compartment 23. The second refrigerant may be guided through a second refrigerant pipe P2.

The second evaporator 77 absorbs surrounding latent heat while evaporating the second refrigerant to generate cool air. The generated cool air may be supplied to the freezing compartment 23 through the second fan 79.

The second compressor 71 may be a hermetically sealed reciprocating compressor like the first compressor 61. However, the second compressor 71 has lower load than the first compressor 61. Consequently, the second compressor 71 may have a smaller size than the first compressor 61.

Since the compressor includes the first compressor 61 and the second compressor 71, heat exchange efficiency is higher than when using a single compressor, thereby achieving energy saving.

The second compressor 71 may be disposed in the machinery compartment 29 together with the first compressor 61 and the first condenser 63. Heat from the first compressor 61, the first condenser 63, and the second compressor 71 may be dissipated by a machinery compartment heat dissipation fan F to dissipate heat from the machinery compartment 29.

The second condenser 73 may not be disposed in the machinery compartment 29 unlike the first compressor 61, the first condenser 63, and the second compressor 71. The second condenser 73 may be formed in a heat dissipation pipe.

Hereinafter, a description will be given of construction of a flow channel device 100 provided at opposite inner walls of the machinery compartment 29, in which the compressor including the first compressor 61 and the second compressor 71, the first condenser 63, and the machinery compartment heat dissipation fan F are disposed, such that external air is introduced into the machinery compartment 29, flows along the machinery compartment 29, and is discharged from the machinery compartment 29.

Figure 4:
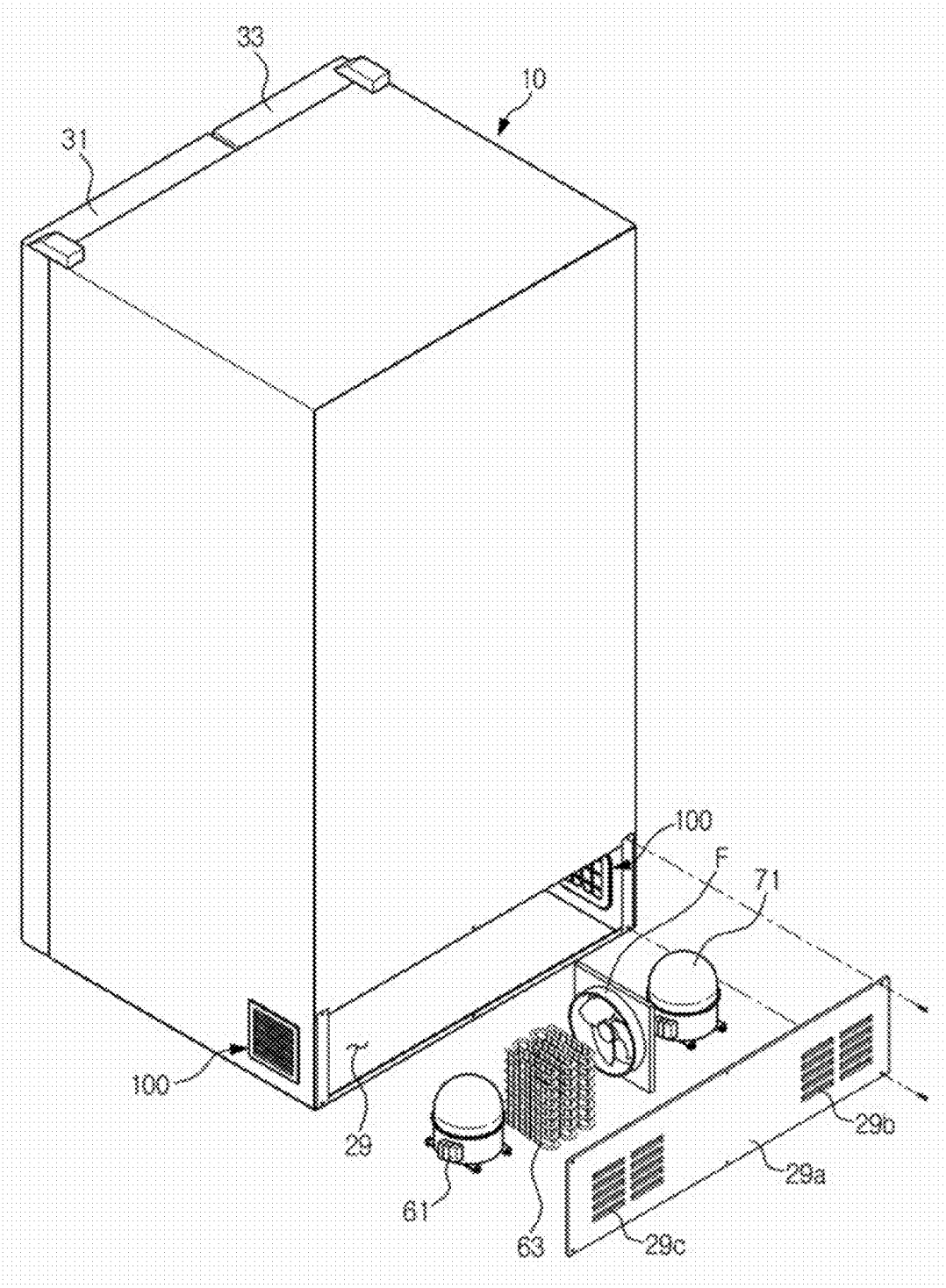
FIG. 4 is a view showing a compressor, a condenser, and a machinery compartment heat dissipation fan disposed in a machinery compartment of the refrigerator according to the embodiment of the present disclosure.
Figure 5:
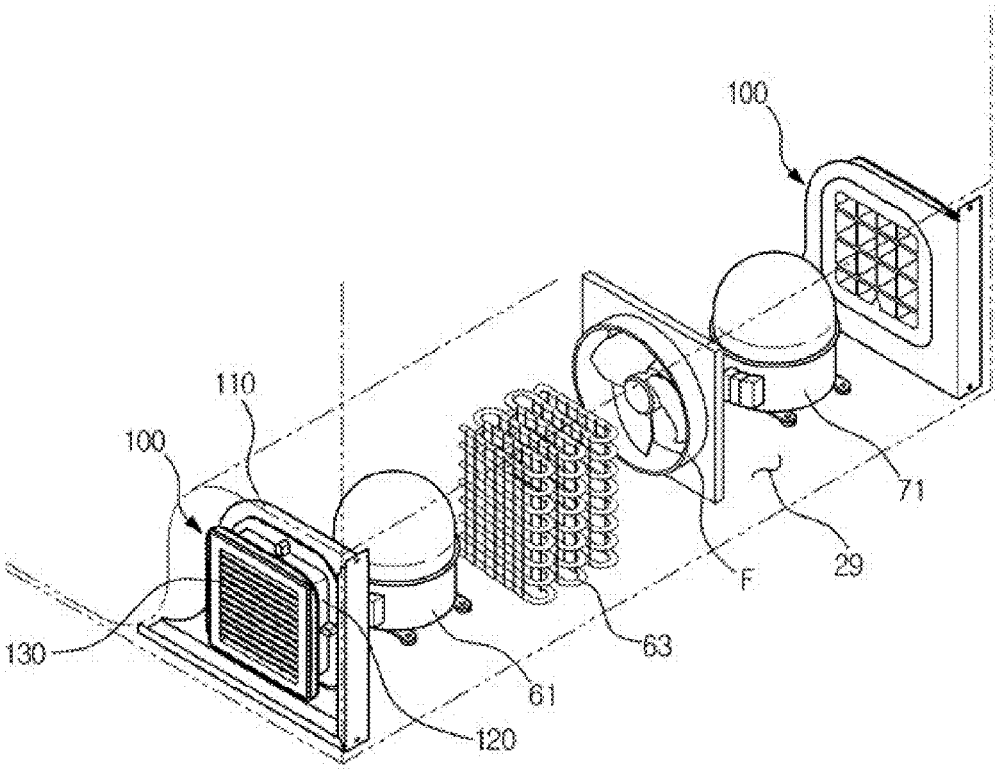
FIG. 5 is a view showing the compressor, the condenser, and the machinery compartment heat dissipation fan disposed in the machinery compartment of the refrigerator according to the embodiment of the present disclosure.
Figure 6:
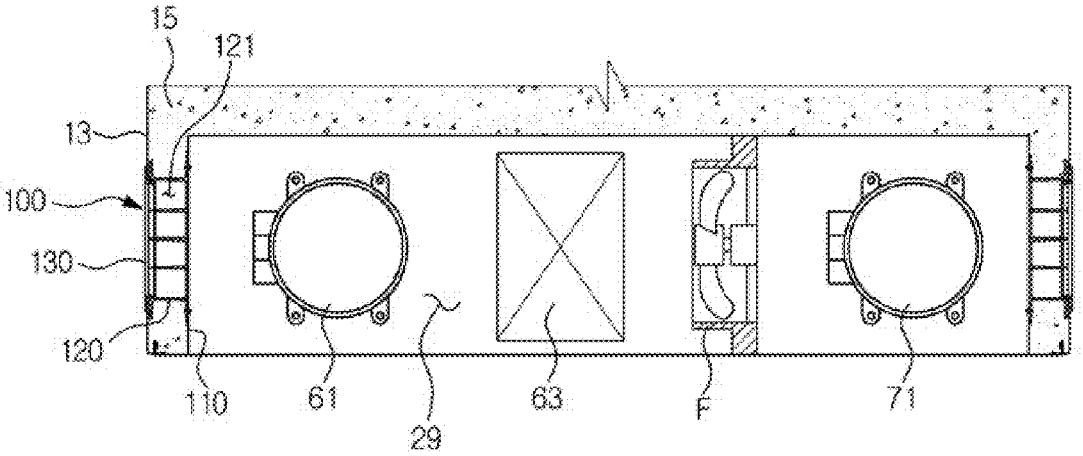
FIG. 6 is a sectional view showing the compressor, the condenser, and the machinery compartment heat dissipation fan disposed in the machinery compartment of the refrigerator of FIG. 5.
Figure 7:
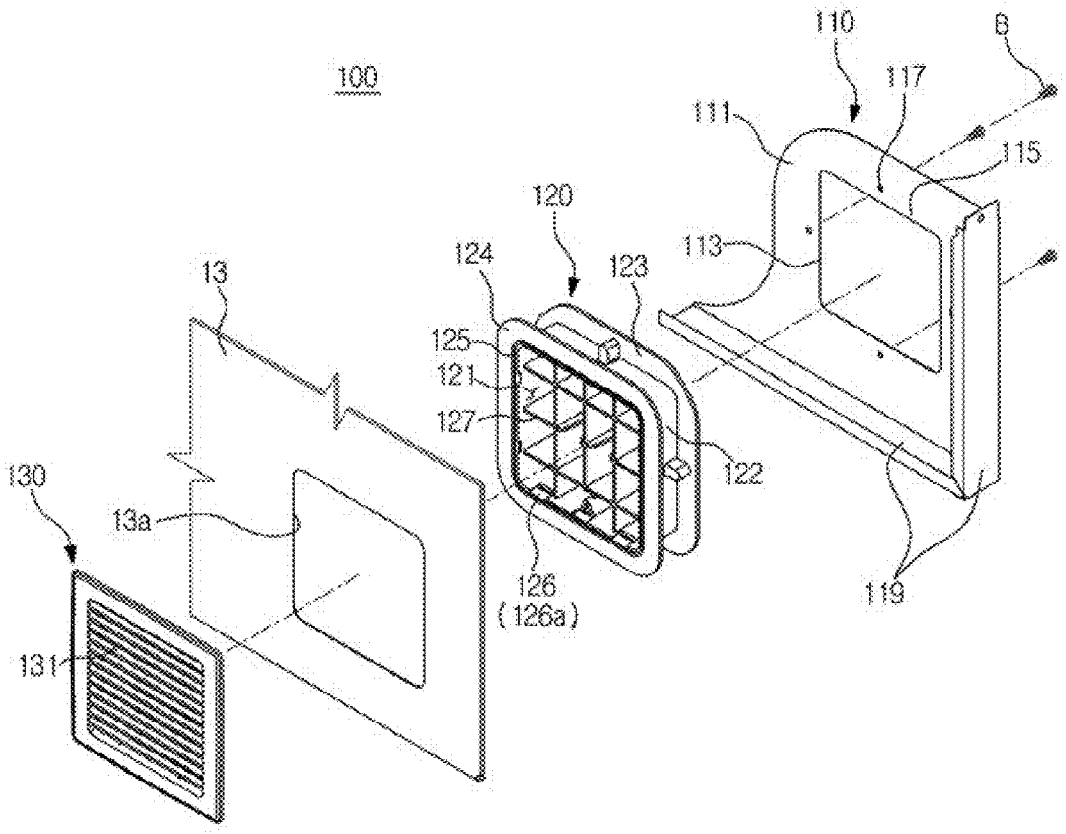
FIG. 7 is an exploded perspective view of a flow channel device according to an embodiment of the present disclosure.

As shown in FIGS. 4 to 6, the flow channel device 100 is provided at opposite inner walls of the machinery compartment 29 such that external air is introduced into the machinery compartment 29, flows through the machinery compartment 29, and is discharged from the machinery compartment 29 to dissipate heat from the compressor 61 and 71 and the first condenser 63 disposed in the machinery compartment 29.

In the machinery compartment 29 is installed the machinery compartment heat dissipation fan F to dissipate heat from the compressor 61 and 71 and the first condenser 63 disposed in the machinery compartment 29. Although the machinery compartment cover 29*a* is provided with the suction port 29*b*, through which external air is suctioned into the machinery compartment 29, and the discharge port 29*c*, through which the air suctioned into the machinery compartment 29 is discharged from the machinery compartment 29, the flow channel device 100 is provided at the opposite inner walls of the machinery compartment 29 to further improve efficiency of dissipating heat from the compressor 61 and 71 and the first condenser 63 since the two compressors 61 and 71 are disposed in the machinery compartment 29.

As shown in FIGS. 5 to 9, the flow channel device 100 includes a machinery compartment inner wall assembly 110 forming the opposite inner side walls of the machinery compartment 29, the machinery compartment inner wall assembly 110 having a first opening 113, a case unit 120 disposed between the machinery compartment inner wall assembly 110 and the outer liner 13, the case unit 120 having an air flow channel 121 corresponding in position to the first opening 113, and a cover unit 130 to cover a second opening 13*a* provided at the outer liner 13 from outside the outer liner 13.

The machinery compartment inner wall assembly 110 includes a plane part 111 forming the inner side wall of the machinery compartment 29 and an extension part 119 extending from the plane part 111 toward the outer liner 13 to form a space in which the case unit 120 is disposed between the plane part 111 and the outer liner 13.

The plane part 111 is provided with the first opening 113, through which external air is supplied into the machinery compartment 29 and air in the machinery compartment 29 is discharged from the machinery compartment 29, and a case unit coupling part 115, to which the case unit 120 is coupled.

The first opening 113 provided at the plane part 111 has a height corresponding to a flow channel of air moved by the machinery compartment heat dissipation fan F disposed in the machinery compartment 29 such that external air supplied into the machinery compartment 29 is rapidly discharged from the machinery compartment 29 by the machinery compartment heat dissipation fan F.

In addition, the size of the first opening 113 may correspond to that of the machinery compartment heat dissipation fan F. This is because, air in the machinery compartment 29 is rapidly discharged from the machinery compartment 29 if the size of the first opening 113 is increased but a space filled with the insulation member 15 at the side wall of the machinery compartment 29 if the size of the first opening 113 is increased with the result that strength of the side wall of the machinery compartment 29 may decrease.

Since the size of the first opening 113 corresponds to that of the machinery compartment heat dissipation fan F, air rapidly flows, thereby improving an effect of dissipating heat from the compressor 61 and 71 and the first condenser 63 disposed in the machinery compartment 29.

The case unit coupling part 115, to which the case unit 120 is coupled, is provided with a plurality of insertion holes 117. A first coupling part 123 of the case unit 120 is provided with a plurality of coupling holes 128 corresponding in position to the insertion holes 117 of the case unit coupling part 115. The case unit 120 is coupled to the machinery compartment inner wall assembly 110 by fastening members B inserted into the insertion holes 117.

Between the case unit 120 and the machinery compartment inner wall assembly 110 is disposed sponge 129 to seal between the case unit 120 and the machinery compartment inner wall assembly 110 such that the insulation member 15 is not introduced into the machinery compartment 29 when the case unit 120 is coupled to the machinery compartment inner wall assembly 110.

Figure 10:
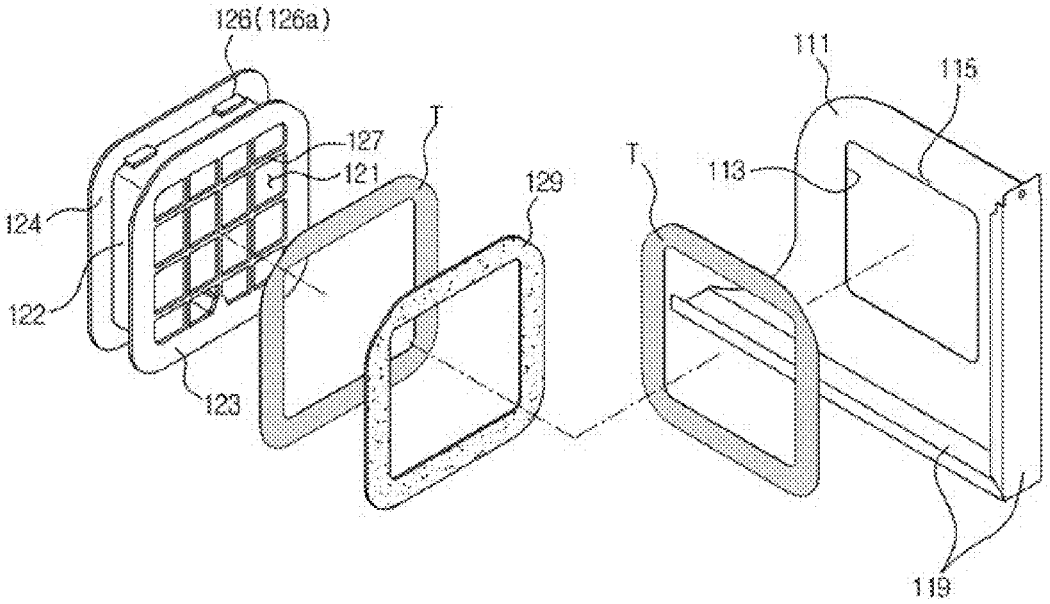
FIG. 10 is a view showing a state in which a case unit is coupled to a machinery compartment inner wall assembly according to another embodiment of the present disclosure.

As shown in FIG. 10, the case unit 120 may be coupled to the machinery compartment inner wall assembly 110 by double-sided tape T, rather than the fastening members B.

In a case in which the case unit 120 is coupled to the machinery compartment inner wall assembly 110 by the double-sided tape T, the coupling holes 128 and the insertion holes 117 are not formed at the case unit 120 and the machinery compartment inner wall assembly 110. Between the case unit 120 and the machinery compartment inner wall assembly 110 is disposed sponge 129 to seal between the case unit 120 and the machinery compartment inner wall assembly 110 in the same manner as in the case in which the case unit 120 is coupled to the machinery compartment inner wall assembly 110 by the fastening members B.

The case unit 120 includes an air flow channel 121 provided at a position corresponding to the first opening 113 of the machinery compartment inner wall assembly 110 to allow air to flow therethrough, a support part 122 to support the insulation member 15 filled around the air flow channel 121, a first coupling part 123 coupled to the case unit coupling part 115 of the machinery compartment inner wall assembly 110, a tight contact part 124 tightly contacting the outer liner 13, a protruding part 125 protruding from the tight contact part 124 such that a portion of the protruding part 125 protrudes outward from the second opening 13*a* provided at the outer liner 13, and a second coupling part 126, to which the cover unit 130 is coupled.

The air flow channel 121 is provided at a position corresponding to the first opening 113 such that the air flow channel 121 extends through the insulation member 15. The air flow channel 121 is provided with a plurality of ribs 127 arranged in the shape of a lattice to reinforce the support part 122, which serves to support the insulation member 15.

Since the ribs 127 are provided at the air flow channel 121, the support part 122 is not damaged due to foaming pressure when the insulation member 15 is filled around the support part 122.

The support part 122 is provided around the air flow channel 121 to support the insulation member 15 filled between the outer liner 13 and the machinery compartment inner wall assembly 110.

The first coupling part 123 is provided in a direction in which the case unit 120 faces the machinery compartment inner wall assembly 110. The first coupling part 123 is provided with a plurality of coupling holes 128 corresponding in position to the insertion holes 117 provided at the case unit coupling part 115 of the machinery compartment inner wall assembly 110 such that the case unit 120 is coupled to the machinery compartment inner wall assembly 110 by the fastening members B.

In a case in which the case unit 120 is coupled to the machinery compartment inner wall assembly 110 by the double-sided tape T, the coupling holes 128 may not be provided at the first coupling part 123 as shown in FIG. 10.

The tight contact part 124 tightly contacts the outer liner 13 at the side opposite the first coupling part 123 of the case unit 120.

The tight contact part 124 tightly contacts the outer liner 13 to prevent the insulation member 15 filled between the outer liner 13 and the machinery compartment inner wall assembly 110 from being discharged out of the outer liner 13. To more securely achieve sealing between the outer liner 13 and the machinery compartment inner wall assembly 110, the tight contact part 124 is provided with the protruding part 125 protruding from the tight contact part 124 such that a portion of the protruding part 125 protrudes outward from the second opening 13*a*.

The protruding part 125 hermetically seals the second opening 13*a* to prevent the insulation member 15 from being discharged from the outer liner 13.

Figure 11:
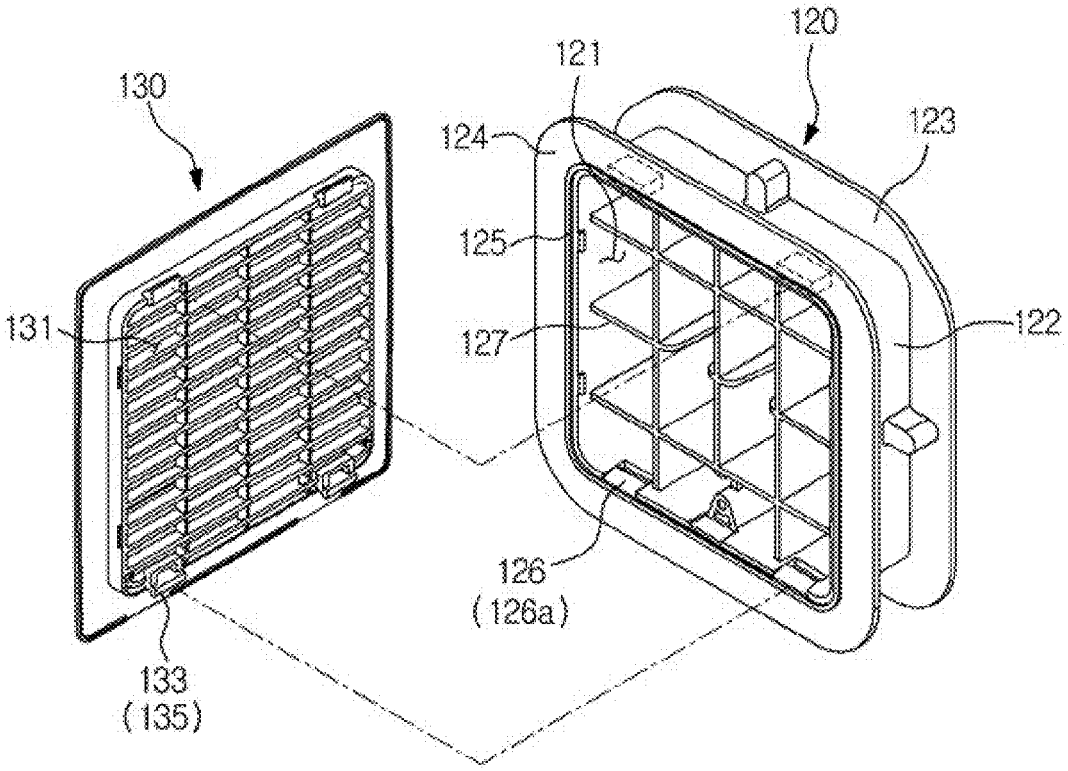
FIG. 11 is a view showing a state in which a cover unit is coupled to a case unit according to an embodiment of the present disclosure.
Figure 12:
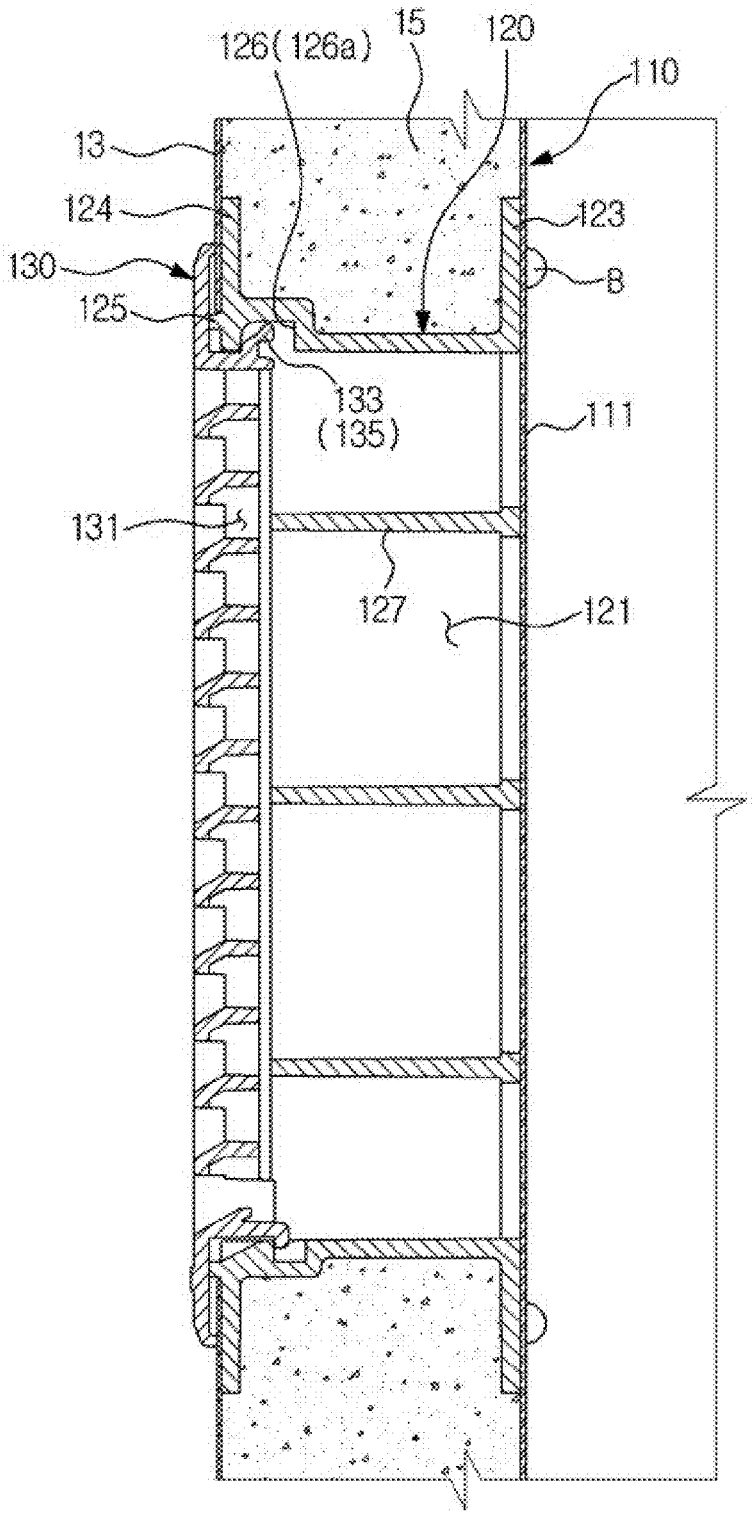
FIG. 12 is a sectional view showing a state in which the cover unit is coupled to the case unit according to the embodiment of the present disclosure.

As shown in FIGS. 11 to 12, the second coupling part 126 is provided to couple the cover unit 130 to the case unit 120.

The second coupling part 126 includes a plurality of hook grooves 126*a*. A fastening part 133 of the cover unit 130 coupled to the second coupling part 126 includes a plurality of hook protrusions 135 corresponding to the hook grooves 126*a*. Consequently, the cover unit 130 is coupled to the case unit 120 by fitting.

Figure 13:
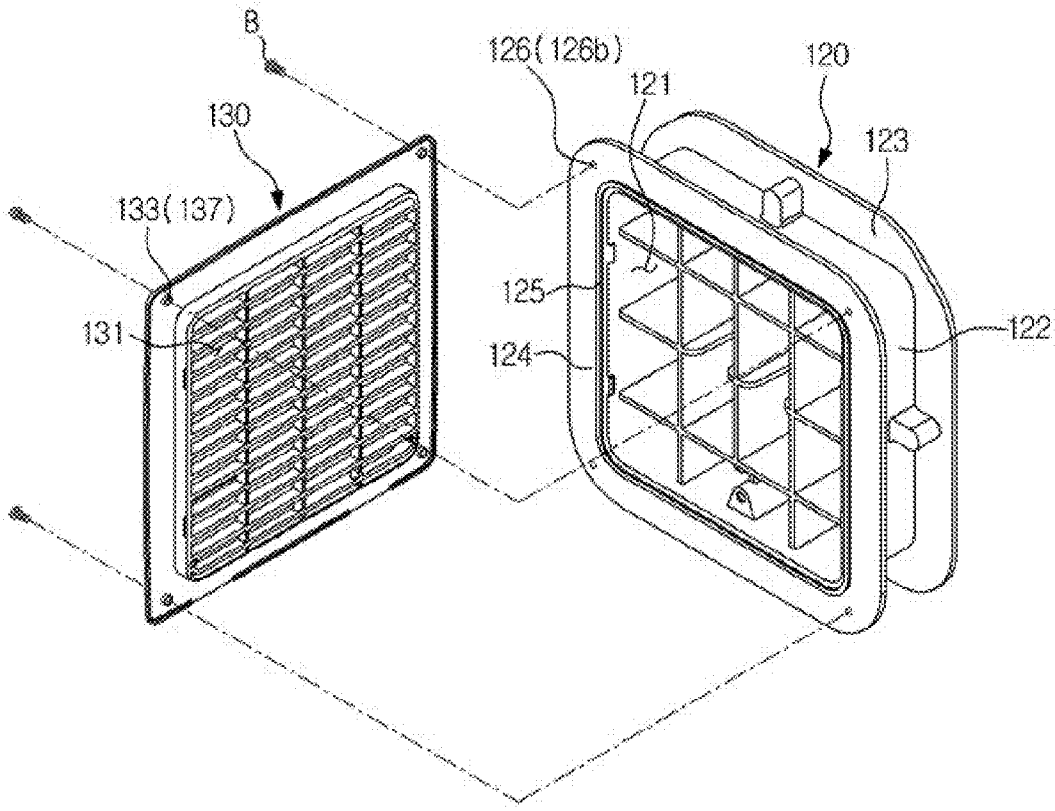
FIG. 13 is a view showing a state in which a cover unit is coupled to a case unit according to another embodiment of the present disclosure.

As shown in FIG. 13, the second coupling part 126 includes a plurality of fastening holes 126*b*. The fastening part 133 of the cover unit 130 coupled to the second coupling part 126 includes a plurality of through holes 137 corresponding to the fastening holes 126*b*. Consequently, the cover unit 130 may be coupled to the case unit 120 by the fastening members B.

The cover unit 130 is provided to cover the seconding opening 13*a* provided at the outer liner 13. The cover unit 130 is coupled to the case unit 120 through the seconding opening 13*a* from outside the outer liner 13.

The cover unit 130 is provided with a plurality of ventilation openings 131 arranged in a grill shape, through which external air is supplied into the machinery compartment 29 or air in the machinery compartment 29 is discharged from the machinery compartment 29. In addition, the ventilation openings 131 prevent external dust and foreign matter from being introduced into the machinery compartment 29.

The fastening part 133 to couple the cover unit 130 to the case unit 120 includes the hook protrusions 135 or the through holes 137 as described above. Consequently, a description thereof will be omitted.

Figure 8:
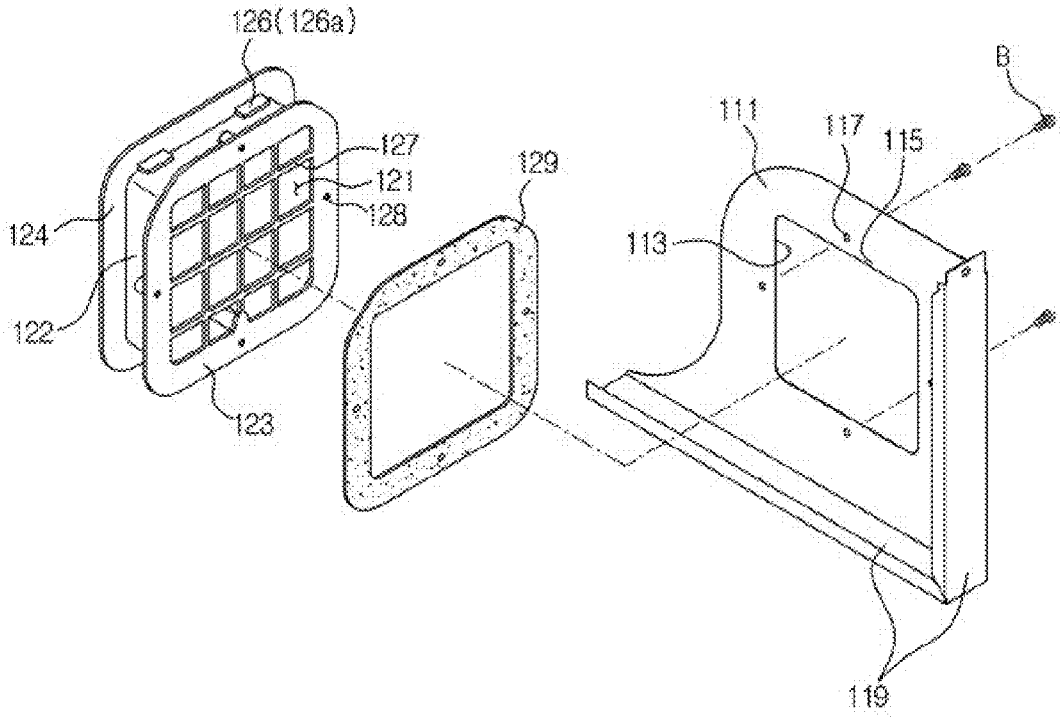
FIG. 8 is a view showing a state in which a case unit is coupled to a machinery compartment inner wall assembly according to an embodiment of the present disclosure.
Figure 9:
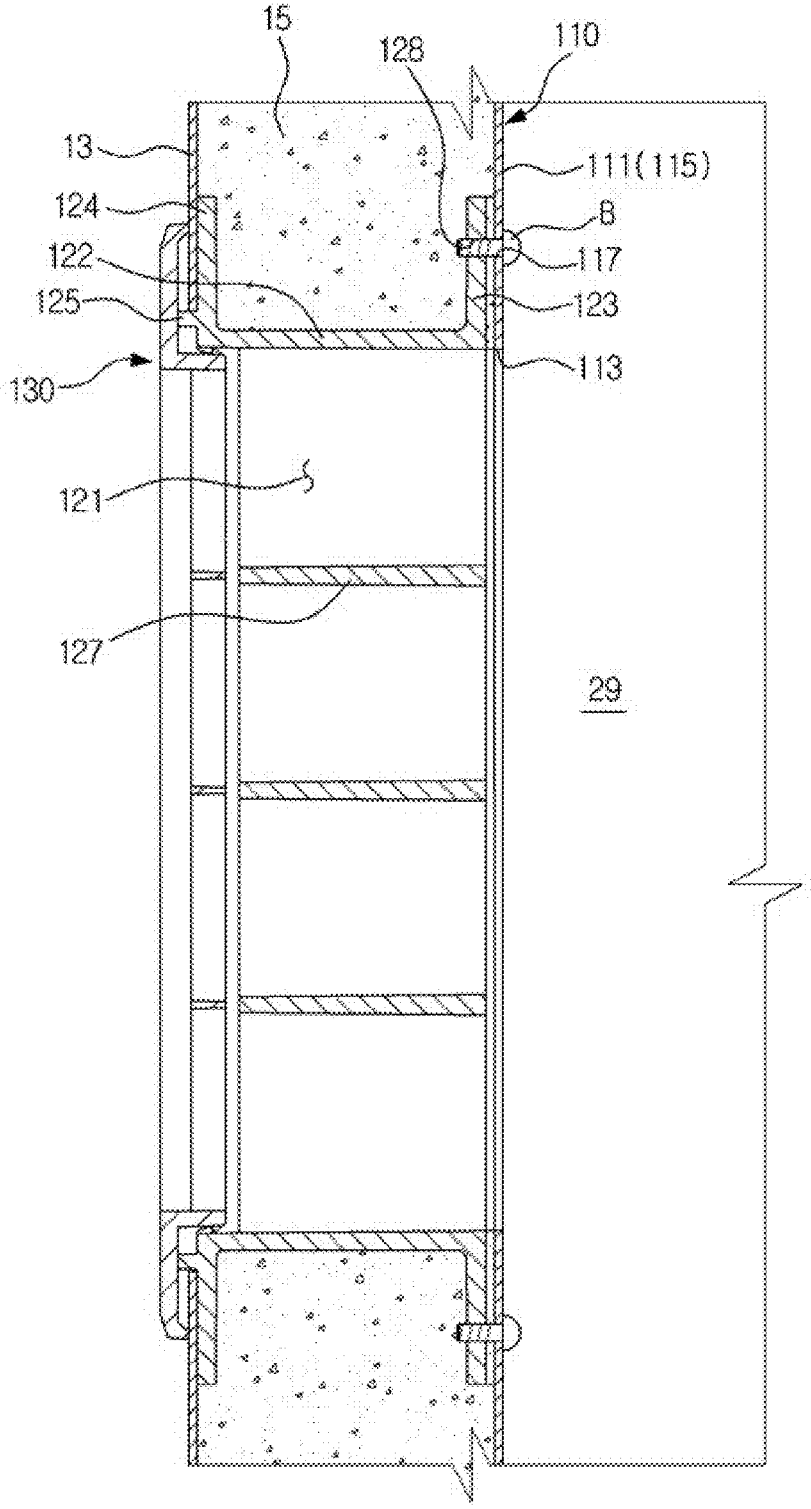
FIG. 9 is a sectional view showing a state in which the case unit is coupled to the machinery compartment inner wall assembly according to the embodiment of the present disclosure.

The flow channel device 100 is assembled as follows. As shown in FIG. 8 or 10, the case unit 120 is coupled to the machinery compartment inner wall assembly 110 by the fastening members B or the double-sided tape T such that the air flow channel 121 of the case unit 120 corresponds to the first opening 113 of the machinery compartment inner wall assembly 110.

When the case unit 120 is coupled to the machinery compartment inner wall assembly 110, the case unit 120 and the machinery compartment inner wall assembly 110 are disposed such that the machinery compartment inner wall assembly 110 forms the side wall of the machinery compartment 29.

When the machinery compartment inner wall assembly 110 and the case unit 120 are disposed, the cover unit 130 is coupled to the case unit 120 from outside the outer liner 13, as shown in FIG. 11 or 13, to cover the second opening 13*a* provided at the outer liner 13.

When all of the machinery compartment inner wall assembly 110, the case unit 120, and the cover unit 130 constituting the flow channel device 100 are coupled, the insulation member 15 filling the space between the inner liner 11 and the outer liner 13 is filled around the support part 122 of the case unit 120.

As is apparent from the above description, according to embodiments of the present disclosure, external air is introduced into the machinery compartment, flows along the machinery compartment, and is discharged from the machinery compartment, thereby improving an effect of dissipating heat from the compressor and the condenser disposed in the machinery compartment.

In addition, power consumption of the refrigerator is lowered, energy efficiency of the refrigerator is improved, and energy is saved.

Although a few embodiments of the present disclosure have been shown and described, it would be appreciated by those skilled in the art that changes may be made in these embodiments without departing from the principles and spirit of the invention, the scope of which is defined in the claims and their equivalents.

What is claimed is:

1. A refrigerator comprising:

a main body comprising:

an inner liner to form a storage compartment, an outer liner to form an external appearance of the refrigerator, and an insulation member filled between the inner liner and the outer liner;

a machinery compartment provided at a lower part of the main body, in which a compressor is disposed; and a pair of flow channel devices respectively provided at opposite sides of the machinery compartment to form a pair of air flow channels, each flow channel device of the pair of flow channel devices including, an inner wall assembly to form an inner side wall at the inner liner at one of the opposite sides of the machinery compartment, to form one of the pair of air flow channels extended through the insulation member between the formed inner side wall and the outer liner, the inner wall assembly supporting the insulation member filled between the inner liner and the outer liner, such that, while external air is introduced through one of the pair of air flow channels at one side among the opposite sides of the machinery compartment and into the machinery compartment, the introduced external air to flow along the machinery compartment and to be discharged from the machinery compartment through another of the pair of air flow channels at other side among the opposite sides of the machinery compartment.

2. The refrigerator according to claim 1, wherein each inner wall assembly includes:

a first opening, a case unit including an air flow channel of the pair of air flow channels, the case unit disposed between the outer liner and the formed inner side wall, the air flow channel positioned corresponding to the first opening, and a cover unit to cover a second opening provided at the outer liner, the second opening corresponding to the air flow channel of the case unit and the first opening.

3. The refrigerator according to claim 2, wherein:
the machinery compartment includes a machinery compartment heat dissipation fan to dissipate heat from the machinery compartment, and
the first opening has a height corresponding to a height of the machinery compartment heat dissipation fan.

4. The refrigerator according to claim 3, wherein the inner wall assembly further includes:
a plane part forming the inner side wall of the machinery compartment, and
an extension part extending from the plane part toward the outer liner to form a space in which the case unit is disposed between the plane part and the outer liner.

5. The refrigerator according to claim 4, wherein the plane part is provided with:
the first opening, and
a case unit coupling part, to which the case unit is coupled.

6. The refrigerator according to claim 5, wherein:
the case unit coupling part is provided with a plurality of insertion holes, and
the case unit is coupled to the case unit coupling part by fastening members inserted into the plurality of insertion holes.

7. The refrigerator according to claim 5, wherein the case unit is coupled to the case unit coupling part by adhesive tape.

8. The refrigerator according to claim 5, wherein:
the case unit is coupled to the inner wall assembly such that the air flow channel corresponds to the first opening, and
a sponge is disposed between the case unit and the inner wall assembly to seal a space between the case unit and the inner wall assembly.

9. The refrigerator according to claim 6, wherein the case unit further includes:
a support part to support the insulation member filled around sides of the case unit,
a first coupling part coupled to the case unit coupling part,
a tight contact part tightly contacting the outer liner,
a protruding part protruding from the tight contact part such that a portion of the protruding part protrudes outward from the second opening to seal a space between the outer liner and the case unit, and
a second coupling part, to which the cover unit is coupled.

10. The refrigerator according to claim 9, wherein the air flow channel is provided with a plurality of ribs arranged in a lattice shape to reinforce the support part.

11. The refrigerator according to claim 9, wherein the first coupling part is provided with a plurality of coupling holes corresponding to the plurality of insertion holes such that the case unit is coupled to the inner wall assembly by the fastening members inserted into the plurality of insertion holes.

12. The refrigerator according to claim 9, wherein the cover unit is provided with a plurality of ventilation openings and a fastening part fastened to the case unit.

13. The refrigerator according to claim 12, wherein:
the fastening part comprises a plurality of hook protrusions, and
the second coupling part comprises a plurality of hook grooves corresponding to the hook protrusions such that the cover unit is coupled to the case unit by fitting.

14. The refrigerator according to claim 12, wherein:
the fastening part comprises a plurality of through holes, and
the second coupling part comprises a plurality of fastening holes corresponding to the plurality of through holes such that the cover unit is coupled to the case unit by fastening members extending through the plurality of through holes.

15. A refrigerator comprising:
a main body comprising:
an inner liner to form a storage compartment,
an outer liner to form an external appearance thereof, and
an insulation member filled between the inner liner and the outer liner;
a machinery compartment provided at a lower part of the main body, in which a compressor is disposed;
a pair of flow channel devices respectively provided at opposite sides of the machinery compartment, each flow channel device of the pair of the flow channel devices including:
an inner wall assembly forming an inner side wall at the inner liner at the one side among the opposite sides of the machinery compartment, the inner wall assembly including:
a first opening;
a case unit coupled to the inner wall assembly such that the case unit is disposed between the outer liner and the inner side wall, the case unit including:
an air flow channel corresponding to the first opening and extended through the insulation member between the inner side wall and the outer liner, the case unit supporting the insulation member filled between the inner liner and the outer liner; and
a cover unit to cover a second opening provided at the outer liner, the second opening corresponding to the air flow channel of the case unit and the first opening, the cover unit having a plurality of ventilation openings.

16. The refrigerator according to claim 15, wherein:
the machinery compartment has a machinery compartment heat dissipation fan to dissipate heat from the machinery compartment, and
the first opening has a height corresponding to a height of the machinery compartment heat dissipation fan.

17. The refrigerator according to claim 16, wherein the inner wall assembly further includes:
a plane part forming the inner side wall of the machinery compartment, the plane part being provided with:
the first opening, and
a case unit coupling part, to which the case unit is coupled, and
an extension part extending from the plane part toward the outer liner to form a space in which the case unit is disposed between the plane part and the outer liner.

18. The refrigerator according to claim 17, wherein:
the case unit is coupled to the inner wall assembly such that the air flow channel corresponds to the first opening, and
a sponge is disposed between the case unit and the inner wall assembly to seal a space between the case unit and the inner wall assembly.

19. The refrigerator according to claim 17, wherein the case unit further includes:
a support part to support the insulation member filled around sides of the case unit,
a first coupling part coupled to the case unit coupling part,
a tight contact part tightly contacting the outer liner, a protruding part protruding from the tight contact part such that a portion of the protruding part protrudes outward from the second opening to seal a space between the outer liner and the case unit, and a second coupling part, to which the cover unit is coupled.

20. The refrigerator according to claim 19, wherein the air flow channel is provided with a plurality of ribs arranged in a lattice shape to reinforce the support part.

21. A refrigerator comprising:

a main body comprising:

an inner liner to form a storage compartment, an outer liner disposed outside of the inner liner to form an external appearance thereof, and an insulation member filled between the inner liner and the outer liner;

a machinery compartment provided at a lower part of the main body, in which a compressor is disposed; and a pair of flow channel devices respectively provided at opposite sides of the machinery compartment, each of the flow channel devices including:

a first opening provided at the inner liner of the machinery compartment at one side among the opposite sides of the machinery compartment, and a case unit disposed between the first opening and the outer lining, the case unit extended through the insulation member to interconnect the first opening and a second opening in the outer liner and supporting the insulation member filled between the inner liner and the outer liner.

22. A refrigerator having a main body including an inner liner defining a storage compartment, an outer liner forming an exterior of the refrigerator, an insulation member formed between the inner liner and the outer liner, and a machinery compartment formed at a lower side of a rear of the main body, the machinery compartment comprising:

at least one of a compressor and a condenser;

a heat dissipation fan;

a machinery compartment cover coupled to a rear of the machinery compartment, the machinery compartment cover including a suction port and a discharge port;

a pair of flow channel devices respectively provided at opposite lateral sides of the machinery compartment, each flow channel device of the pair of flow channel devices including, an inner wall assembly to form an inner side wall at the inner liner at one of the opposite lateral sides of the machinery compartment and an air flow channel extended through the insulation member between the formed inner side wall and the outer liner, the inner wall assembly supporting the insulation member filled between the inner liner and the outer liner.

23. The refrigerator according to claim 22, wherein the pair of flow channel devices respectively formed at opposite lateral sides of the machinery compartment are respectively arranged perpendicularly to the suction port and discharge port of the machinery compartment cover.

* * * * *